US005987407A

United States Patent [19]

Wu et al.

[11] Patent Number: 5,987,407

[45] Date of Patent: Nov. 16, 1999

[54] SOFT-CLIPPING POSTPROCESSOR SCALING DECODED AUDIO SIGNAL FRAME SATURATION REGIONS TO APPROXIMATE ORIGINAL WAVEFORM SHAPE AND MAINTAIN CONTINUITY

[75] Inventors: Shuwu Wu, Foothill Ranch; John Mantegna, Irvine, both of Calif.

[73] Assignee: America Online, Inc., Dulles, Va.

[21] Appl. No.: 09/172,065

[22] Filed: Oct. 13, 1998

Related U.S. Application Data

[62] Division of application No. 08/958,567, Oct. 28, 1997.

[51] Int. Cl.[6] ..... G10L 3/02

[52] U.S. Cl. ..... 704/224; 704/225

[58] Field of Search ..... 704/224, 225

[56] References Cited

U.S. PATENT DOCUMENTS

| | | | |
|---|---|---|---|
| 4,811,398 | 3/1989 | Copperi et al. | 704/230 |
| 4,868,867 | 9/1989 | Davidson et al. | 704/230 |
| 5,371,544 | 12/1994 | Jacquin et al. | 348/398 |
| 5,388,181 | 2/1995 | Anderson et al. | 704/203 |
| 5,596,676 | 1/1997 | Swaminathan et al. | 704/208 |
| 5,812,969 | 9/1998 | Barber, Jr. et al. | 704/224 |
| 5,815,532 | 9/1998 | Bhattacharya et al. | 375/301 |

FOREIGN PATENT DOCUMENTS

| | | | |
|---|---|---|---|
| 7-154469 | 6/1995 | Japan | H04M 1/65 |
| 7-210987 | 8/1995 | Japan | G11B 20/00 |

OTHER PUBLICATIONS

Pamela C. Cosman, Robert M. Gray, and Martin Vetterli, "Vector Quantization of Image Subbands: A Survey", IEEE Trans. on Image Processing, vol. 5, No. 2, pp. 202–225, Feb. 1996.

*Collected Papers on Digital Audio Bit Rate Reduction*, Neil Gilchrist and Christer Grewin, Eds., Audio ES, Jun. 1996.

*Primary Examiner*—David R. Hudspeth
*Assistant Examiner*—Falivaldis Ivars Smits
*Attorney, Agent, or Firm*—Fish & Richardson P.C.

[57] ABSTRACT

An audio coder/decoder ("codec") that is suitable for real-time applications due to reduced computational complexity, and a novel adaptive sparse vector quantization (ASVQ) scheme and algorithms for general purpose data quantization. The codec provides low bit-rate compression for music and speech, while being applicable to higher bit-rate audio compression. The codec includes an in-path implementation of psychoacoustic spectral masking, and frequency domain quantization using the novel ASVQ scheme and algorithms specific to audio compression. More particularly, the inventive audio codec employs frequency domain quantization with critically sampled subband filter banks to maintain time domain continuity across frame boundaries. The input audio signal is transformed into the frequency domain in which in-path spectral masking can be directly applied. This in-path spectral masking usually results in sparse vectors. The ASVQ scheme is a vector quantization algorithm that is particularly effective for quantizing sparse signal vectors. In the preferred embodiment, ASVQ adaptively classifies signal vectors into six different types of sparse vector quantization, and performs quantization accordingly. The ASVQ technique applies to general purpose data quantization as well as to quantization in the context of audio compression. The invention also includes a "soft clipping" algorithm in the decoder as a post-processing stage. The soft clipping algorithm preserves the waveform shapes of the reconstructed time domain audio signal in a frame- or block-oriented stateless manner while maintaining continuity across frame or block boundaries. The invention includes related methods, apparatus, and computer programs.

3 Claims, 8 Drawing Sheets

SOFT-CLIPPING POSTPROCESSOR SCALING DECODED AUDIO SIGNAL FRAME SATURATION REGIONS TO APPROXIMATE ORIGINAL WAVEFORM SHAPE AND MAINTAIN CONTINUITY

This is a divisional of U.S. application Ser. No. 08/958,567, filed Oct. 28, 1997 (pending).

TECHNICAL FIELD

This invention relates to compression and decompression of audio signals, and more particularly to a method and apparatus for compression and decompression of audio signals using adaptive sparse vector quantization, and a novel adaptive sparse vector quantization technique for general purpose data compression.

BACKGROUND

Audio compression techniques have been developed to transmit audio signals in constrained bandwidth channels and store such signals on media with limited capacity. In audio compression, no assumptions can be made about the source or characteristics of the sound. Algorithms must be general enough to deal with arbitrary types of audio signals, which in turn poses a substantial constraint on viable approaches. (In this document, the term "audio" refers to a signal that can be any sound in general, such as music of any type, speech, and a mixture of music and voice). General audio compression thus differs from speech coding in one significant aspect: in speech coding where the source is known a priori, model based algorithms are practical.

Many audio compression techniques rely upon a "psychoacoustic model" to achieve substantial compression. Psychoacoustics describes the relationship between acoustic events and the resulting perceived sounds. Thus, in a psychoacoustic model, the response of the human auditory system is taken into account in order to remove audio signal components that are imperceptible to human ears. Spectral "masking" is one of the most frequently exploited psychoacoustic phenomena. "Masking" describes the effect by which a fainter, but distinctly audible, signal becomes inaudible when a louder signal occurs simultaneously with, or within a very short time of, the lower amplitude signal. Masking depends on the spectral composition of both the masking signal and the masked signal, and on their variations with time. For example, FIG. 1 is plot of the spectrum for a typical signal (trumpet) 10 and of the human perceptual threshold 12. The perceptual threshold 12 varies with frequency and power. Note that a great deal of the signal 10 is below the perceptual threshold 12 and therefore redundant. Thus, this part of the audio signal may be discarded.

One well-known technique that utilizes a psychoacoustic model is embodied in the MPEG-Audio standard (ISO/IEC 11172-3; 1993(E)) (here, simply "MPEG"). FIG. 2 is a block diagram of a conventional MPEG audio encoder. A digitized audio signal (e.g., a 16-bit pulse code modulated—PCM—signal) is input into one or more filter banks 20 and into a psychoacoustic "model" 22. The filter banks 20 perform a time-to-frequency mapping, generating multiple subbands (e.g., 32). The filter banks 20 are "critically" sampled so that there are as many samples in the analyzed domain as there are in the time domain. The filter banks 20 provide the primary frequency separation for the encoder; a similar set of filter banks 20 serves as the reconstruction filters for the corresponding decoder. The output samples of the filter banks 20 are then quantized by a bit or noise allocation function 24.

The parallel psychoacoustic model 22 calculates a "just noticeable" noise level for each band of the filter banks 20, in the form of a "signal-to-mask" ratio. This noise level is used in the bit or noise allocation function 24 to determine the actual quantizer and quantizer levels. The quantized samples from the bit or noise allocation function 24 are then applied to a bitstream formatting function 26, which outputs the final encoded (compressed) bitstream. The output of the psychoacoustic model 22 may be used to adjust bit allocations in the bitstream formatting function 26, in known fashion.

Most approaches to audio compression can be broadly divided into two major categories: time and frequency domain quantization. An MPEG coder/decoder ("codec") is an example of an approach employing time domain scalar quantization. In particular, MPEG employs scalar quantization of the time domain signal in individual subbands (typically 32 subbands) while bit allocation in the scalar quantizer is based on a psychoacoustic model, which is implemented separately in the frequency domain (dual-path approach).

MPEG audio compression is limited to applications with higher bit-rates, 1.5 bits per sample and higher. At 1.5 bits per sample, MPEG audio does not preserve the full range of frequency content. Instead, frequency components at or near the Nyquist limit are thrown away in the compression process. In a sense, MPEG audio does not truly achieve compression at the rate of 1.5 bits per sample.

Quantization is one of the most common and direct techniques to achieve data compression. There are two basic quantization types: scalar and vector. Scalar quantization encodes data points individually, while vector quantization groups input data into vectors, each of which is encoded as a whole. Vector quantization typically searches a codebook (a collection of vectors) for the closest match to an input vector, yielding an output index. A de-quantizer simply performs a table lookup in an identical codebook to reconstruct the original vector. Other approaches that do not involve codebooks are known, such as closed form solutions.

It is well known that scalar quantization is not optimal with respect to rate/distortion tradeoffs. Scalar quantization cannot exploit correlations among adjacent data points and thus scalar quantization yields higher distortion levels than vector quantization for a given bit rate. Vector quantization schemes usually can achieve far better compression ratios at a given distortion level. Thus, time domain scalar quantization limits the degree of compression, resulting in higher bit-rates. Further, human ears are sensitive to the distortion associated with zeroing even a single time domain sample. This phenomenon makes direct application of traditional vector quantization techniques on a time domain audio signal an unattractive proposition, since vector quantization at the rate of 1 bit per sample or lower often leads to zeroing of some vector components (that is, time domain samples).

Frequency domain quantization based audio compression is an alternative to time domain quantization based audio compression. However, there is a significant difficulty that needs to be resolved in frequency domain quantization based audio compression. The input audio signal is continuous, with no practical limits on the total time duration. It is thus necessary to encode the audio signal in a piecewise manner. Each piece is called an audio encode or decode frame. Performing quantization in the frequency domain on a per frame basis generally leads to discontinuities at the frame boundaries. Such discontinuities result in objectionable audible artifacts (e.g., "clicks" and "pops"). One remedy to this discontinuity problem is to use overlapped frames, which results in proportionally lower compression ratios and higher computational complexity. A more popular approach is to use "critically filtered" subband filter banks, which employ a history buffer that maintains continuity at frame boundaries, but at a cost of latency in the codec-reconstructed audio signal. Another complex approach is to enforce boundary conditions as constraints in audio encode and decode processes.

The inventors have determined that it would be desirable to provide an audio compression technique suitable for real-time applications while having reduced computational complexity. The technique should provide low bit-rate compression (about 1-bit per sample) for music and speech, while being applicable to higher bit-rate audio compression. The present invention provides such a technique.

SUMMARY

The invention includes an audio coder/decoder ("codec") that is suitable for real-time applications due to reduced computational complexity. The invention provides low bit-rate compression for music and speech, while being applicable to higher bit-rate audio compression. The invention includes an in-path implementation of psychoacoustic spectral masking, and frequency domain quantization using a novel adaptive sparse vector quantization (ASVQ) scheme and algorithms specific to audio compression.

More particularly, the inventive audio codec employs frequency domain quantization with critically sampled subband filter banks to maintain time domain continuity across frame boundaries. The invention uses an in-path spectral masking algorithm which reduces computational complexity for the codec. The input audio signal is transformed into the frequency domain in which spectral masking can be directly applied. This in-path spectral masking usually results in sparse vectors. The sparse frequency domain signal is itself quantized and encoded in the output bit-stream.

The ASVQ scheme used by the invention is a vector quantization algorithm that is particularly effective for quantizing sparse signal vectors. In the preferred embodiment, ASVQ adaptively classifies signal vectors into six different types of sparse vector quantization, and performs quantization accordingly. ASVQ is most effective for sparse signals; however, it provides multiple types of vector quantization that deal with different types of occasionally non-sparse or dense signal vectors. Because of this ability to deal with dense vectors as well as sparse ones, ASVQ is a general-purpose vector quantization technique.

The invention also includes a "soft clipping" algorithm in the decoder as a post-processing stage. The soft clipping algorithm preserves the waveform shapes of the reconstructed time domain audio signal in a frame- or block-oriented stateless manner while maintaining continuity across frame or block boundaries. The soft clipping algorithm provides significant advantages over the conventional "hard clipping" methods and becomes highly desirable for low bit-rate audio compression. Although the soft clipping algorithm is applied to reconstructed time domain audio signals in the preferred audio codec, its applications extend to saturated signals in general, time domain or otherwise (frequency domain or any type of transformed domain).

One aspect of the invention includes a method for compressing a digitized time-domain audio input signal, including the steps of: filtering the input signal into a plurality of subbands sufficient to provide a frequency domain representation of the input signal; spectrally masking the plurality of subbands using an in-path psychoacoustic model to generate masked subbands; classifying the masked subbands into one of a plurality of quantization vector types; computing vector quantization indices for each quantization vector type; formatting the vector quantization indices for each quantization vector type as an output bit-stream. The invention further includes related apparatus and computer programs.

An advantage of the invention is that in-path spectral masking naturally prepares the frequency domain signal for ASVQ, a novel and yet general adaptive vector quantization technique for signal vectors that often contain a significant number of zero elements. In-path spectral masking and ASVQ are a natural match in the context of audio compression: the former prepares for the latter and the latter requires the former for efficient quantization.

Other advantages of the invention include:

- A new general-purpose adaptive sparse vector quantization technique for data compression. Such data may include audio, image, and other types of data.
- Adaptive quantization type selection in accordance with the invention chooses an optimal quantization technique based on time-varying properties of the input. This approach avoids some problems of the prior art, such as varying the number of subbands which intrinsically cause discontinuities to which the human auditory system is quite sensitive. ASVQ simply searches for the best possible quantization for a given input vector, and does not directly cause any discontinuities.
- Higher data compression ratio or lower bit-rate, ideal for applications like real-time or non-real-time audio transmission over the Internet with limited connection bandwidth.
- Ultra-low bit-rate compression of certain types of audio/music. For example, one embodiment achieves audio compression at variable low bit-rates in the neighborhood of 0.5 to 1.2 bits per sample. This audio compression system is extensible to audibly transparent sound coding and reproduction at higher bit-rates.
- Low computational complexity, which leads to fast real-time applications.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference numbers and designations in the various drawings indicate like elements.

DETAILED DESCRIPTION

Audio Encoding

Figure 3A:
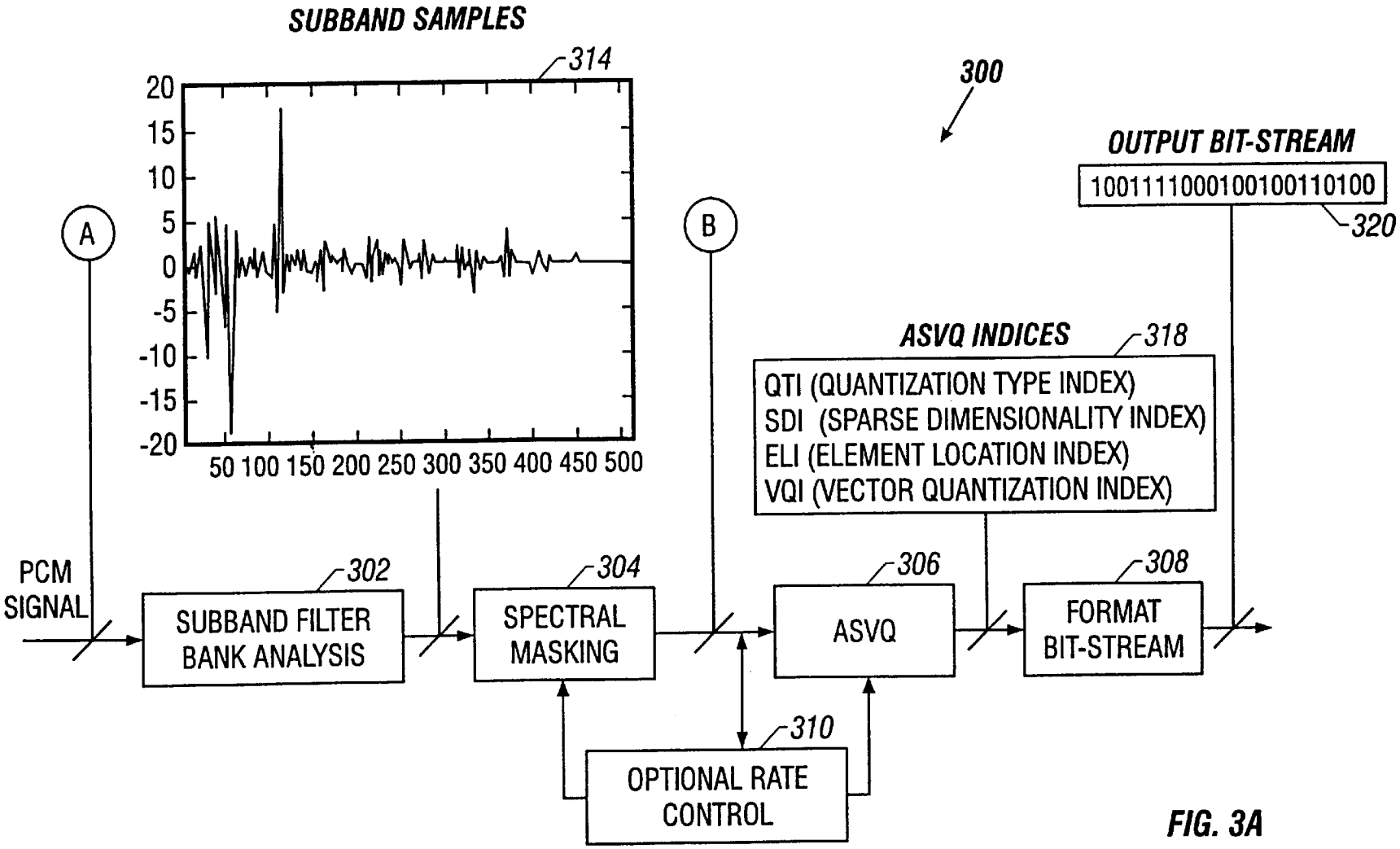
FIG. 3 is a block diagram of a preferred audio encoding system in accordance with the invention.
Figure 3B:
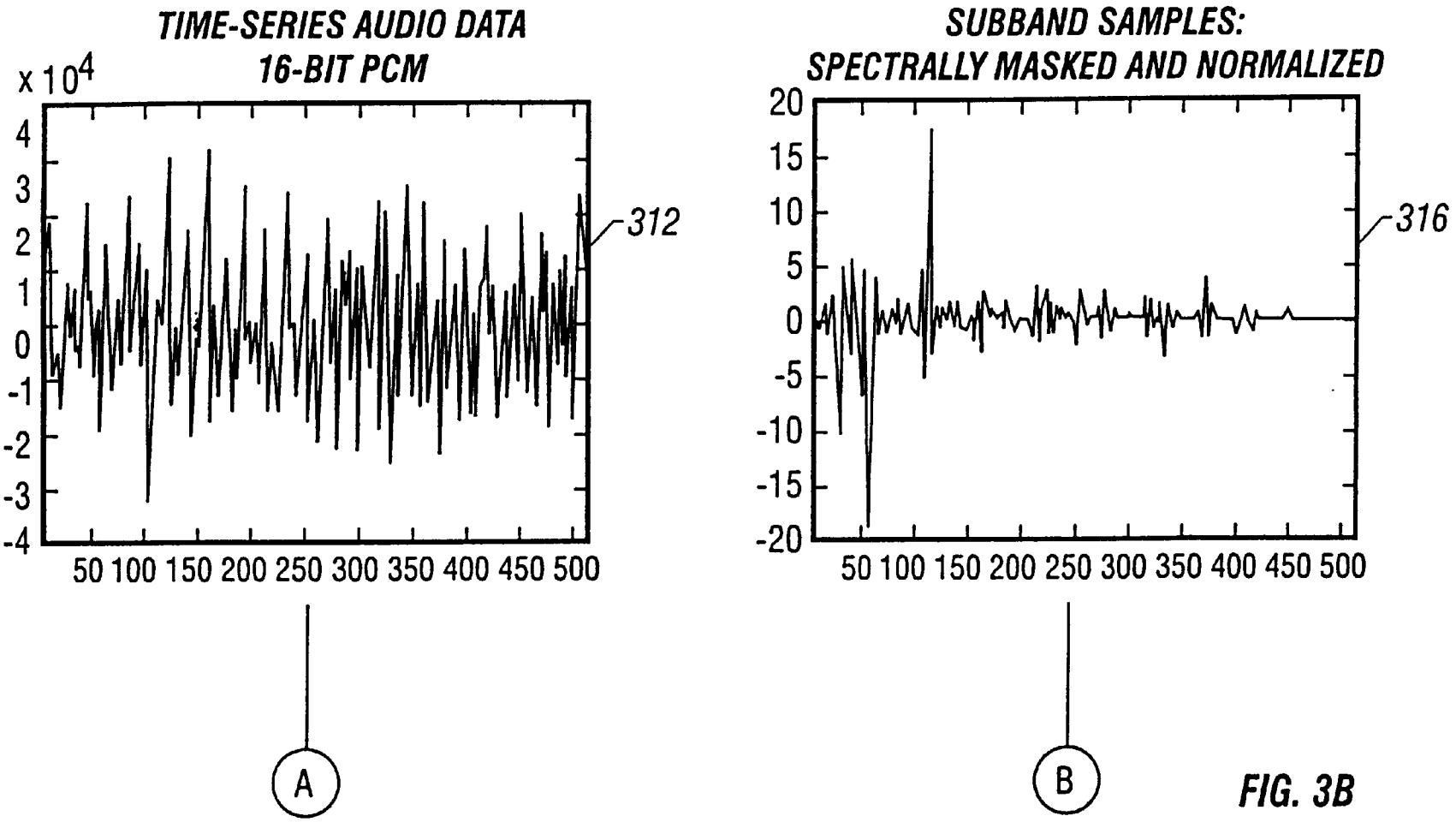

FIG. 3 is a block diagram of a preferred audio encoding system in accordance with the invention. The audio encoder 300 may be implemented in software or hardware, and has five basic components: subband filter bank analysis 302; in-path spectral masking 304; adaptive sparse vector quantization 306; bit-stream formatting for output 308; and an optional rate control 310 as a feed back loop to the spectral masking component 304. Each of these components is described below.

Subband Filter Bank Analysis

The audio encoder 300 preferably receives an input audio signal in the form of a pulse-coded modulation (PCM) 16-bit sampled time-series signal 312. Generation of PCM coded audio is well-known in the art. The input signal 312 is applied to the subband filter bank analysis component 302 which generates a number of channels, Nc, from an input frame which is critically filtered to yield Nc subband samples. With Nc sufficiently high (no less than 64, and preferably 256 or 512), the output subband samples can be regarded as a frequency domain representation of the input time domain signal.

Figure 1:
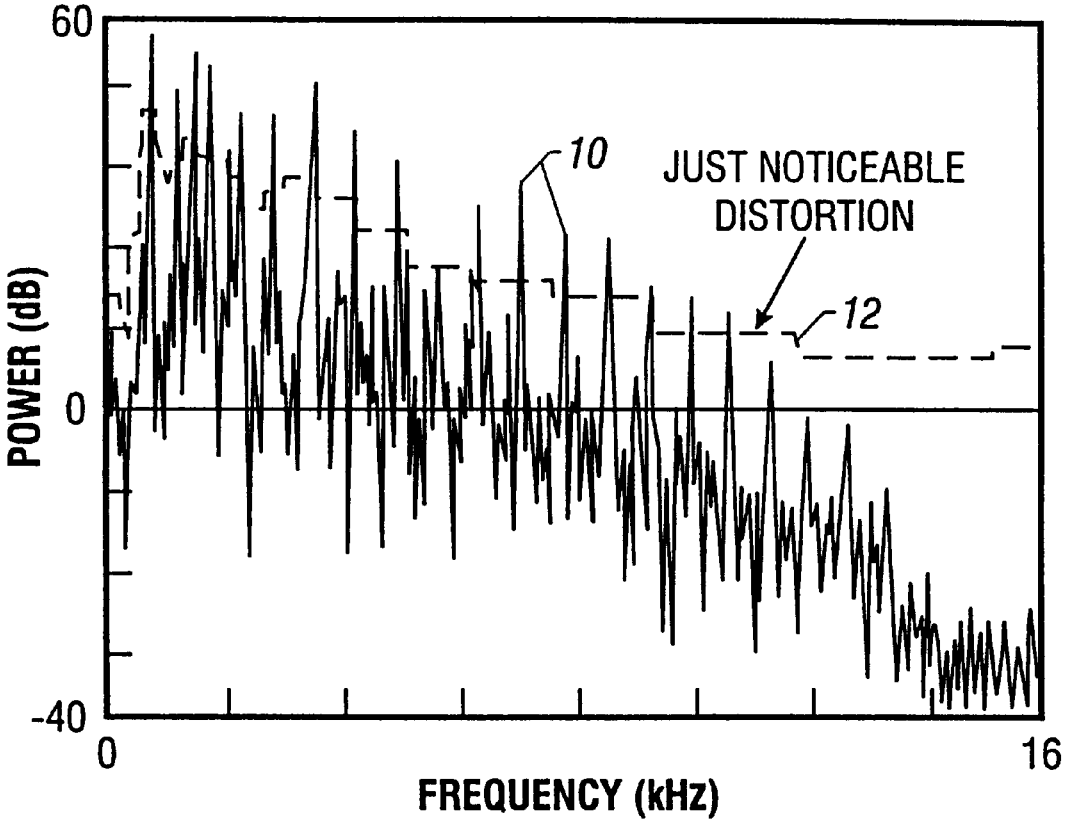
FIG. 1 (PRIOR ART)
FIG. 1 is plot of the spectrum for a typical signal (trumpet) and of the human perceptual threshold, as is known in the prior art.
Figure 2:
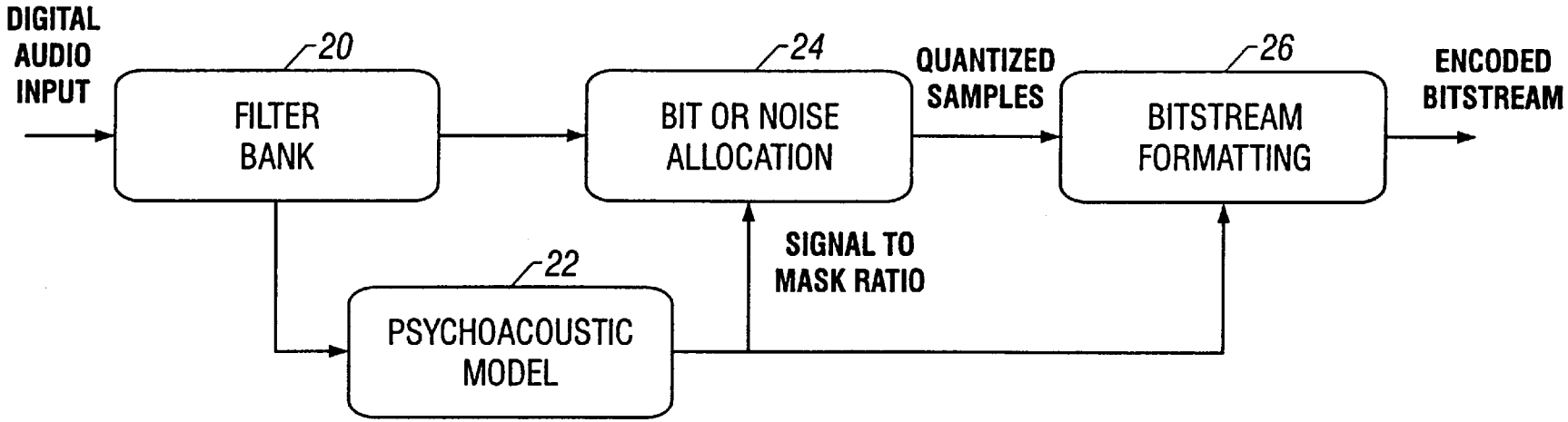
FIG. 2 (PRIOR ART)
FIG. 2 is a block diagram of a conventional MPEG audio encoder, as is known in the prior art.

The preferred implementation of the subband filter bank analysis component 302 is similar to the filter banks 20 of FIG. 2 for an MPEG audio encoder, with the following parameter changes:

- The number of subbands should be no less than 64 (versus a typical 32 for MPEG), and preferably 256 or 512 for an 11.025 KHz input signal sample rate.
- More aggressive windowing is used (e.g., a Kaiser-Bessel window with beta parameter exceeding 20).
- A shorter history buffer is used to reduce codec latency, typically 6 or 8 times the number of subbands (versus a typical multiplier of 16 for MPEG).
- Each encode frame consists of 1 subband sample per subband (versus typically 12 or 36 for MPEG, layer dependent).
- The well-known Fast Discrete Cosine Transform (Fast DCT) is used in performing the Modified DCT algorithm of the MPEG Audio standard.

The output of the subband filter bank analysis component 302 is a set of subband samples 314 for each frame of input signals. As shown in the illustrated embodiment, much of the energy in the input signal 312 is in several lower frequencies, especially near 25 Hz, 50 Hz, and 100 Hz.

Spectral Masking: In-Path Implementation of Psychoacoustic Model

As noted above, spectral masking entails the idea that relatively weak spectral content in the vicinity of a strong or a group of strong spectral components may not be perceptible by human ears. Consequently, a psychoacoustic model is employed to throw away such imperceptible frequency content, an extremely useful step towards audio data compression.

The audio codec of the invention differs from conventional implementations of spectral masking by using an in-path implementation. Conventional schemes involve encoding the audio signal in one signal path while carrying out spectral masking in a separate and parallel signal path. The result is total flexibility in implementing spectral masking but at a higher cost of computational complexity. The in-path implementation of the invention actually performs spectral masking on the signal to be encoded. Thus, there is only one signal path for both encoding and spectral masking. Advantages of this approach are reduced computational complexity and natural compatibility with ASVQ (discussed below).

In-path implementation also simplifies rate control that enables ultra-low bit-rate compression with good reproductive quality of certain types of music or sound. In some cases the bit-rate can be as low as 0.5 bits per sample with acceptable quality, a feat that has not been achieved by any state-of-the-art audio compression algorithm to the best knowledge of the inventors. The preferred implementation is described as follows.

At encode initialization:

(1) Calculate a "linear frequency-to-Bark" lookup table, F2B, based on the following equations ("Barks" are units of a frequency scale derived by mapping frequencies to critical-band numbers; critical band numbers are based on empirically derived data describing the frequency response of the human auditory system):

$$f=0\rightarrow f_n;,$$

$$F2B=6*\sin h^{-1}(f/600);$$

where $f_n$ is the Nyquist frequency (half of the sample frequency) in Hz.

(2) Calculate a "Bark-to-linear frequency" lookup table, B2F, based on the following equations:

$$B=0\rightarrow Bn,$$

$$B2F=600*\sin h(B/6);$$

where $B_n$ is the Nyquist frequency in Barks and B2F is given in Hz.

For each audio encode frame:

(3) Determine $N_{sm}$ as the number of strongest spectral components, where $N_{sm}$ can be either the number of spectral components that are greater than a threshold value $N_t$, or a fraction of the number of subbands $N_{cf}$, or the minimum value of $N_t$ and $N_{cf}$.

(4) Repeat step 5 through 8 for the $N_{sm}$ strongest spectral components, i.e., for $$j=0\rightarrow N_{sm}-1,$$

(5) Determine the $j^{th}$ masker (spectral component) to be tonal (sinusoid-like) or non-tonal based on the following equations:

$$X(j)-X(j+k)\geqq 7\text{dB}=>\text{tonal},$$

$$\text{otherwise}=>\text{non-tonal},$$

$$k=-max_k\rightarrow +max_k;$$

where: X(j) is the spectral level in dB; max_k is the maximum k value, which depends on the sample rate and the number of subbands.

(6) Calculate a masking index av based on the following equations:

$$B(j)=F2B[f(j)],$$

$$\text{tonal}=>av=-1.525-0.275*B(j)-4.5\text{dB},$$

$$\text{non-tonal}=>av=-1.525-0.175*B(j)-0.5\text{dB};$$

where B(j) is the frequency of the $j^{th}$ masker in Barks.

(7) Calculate a differential frequency in a Bark-to-masking factor lookup table, dB2MF, based on the following equations:

$$dB=-3\rightarrow 8,$$

$$vf=vf(dB,X[B(j)];$$

where dB is the differential frequency in Barks; vf is the MPEG Audio masking function which depends on dB and X[B(j)]); and X[B(j)] is the level of the $j^{th}$ masker.

(8) Calculate an individual masking threshold LT(j,i):

$$LT[B(j),B(i)]=X[B(j)]+av+vf,$$

$$LT(j,i)=LT\{B2F[B(j)],B2F[B(i)]\};$$

(9) Calculate:

$$LTg(i)=\sum_{j=0}^{Nsm-1} 10^{LT(j,i)/10}.$$

(10) For each spectral component, set the component to zero if it is less than the global masking threshold:

$$i=0\rightarrow Nc-1,$$

$$SBS(i)\leqq LTg(i)=>SBS(i)=0.$$

A simplified approach can be obtained in the case of low bit-rate audio encoding. The simplification is based on the following approximations:

$$av\approx av(\text{tonality}),$$

$$vf\approx vf(\text{dB}).$$

In other words, av is approximated to be independent of B(j) for the $j^{th}$ masker and vf is approximated to be independent of X[B(j)]. Both approximations are of zero'th order in nature. For low bit rate non-transparent audio encoding, such approximations yield good and reasonable re-constructed audio output while the computational complexity is greatly reduced.

The output of the spectral masking component 304 is a set of spectrally masked subband samples 316 for each frame of input signals. As shown in the illustrated embodiment, a number of frequencies have been reduced to zero amplitude, as being inaudible.

Adaptive Sparse Vector Quantization Encoding

Adaptive sparse vector quantization is a general-purpose vector quantization technique that applies to arbitrary input vectors. However, it is most efficient in achieving a high degree of compression if the input vectors are mostly sparse. The basic idea in sparse vector quantization (SVQ) is to encode the locations of non-zero elements in a sparse vector and subsequently collapse the sparse vector into a reduced vector of all non-zero elements. This reduced vector, whose dimensionality is called sparse dimensionality, is then quantized by a conventional vector quantization technique, such as product lattice-pyramid vector quantization or split-vector quantization. In accordance with the invention, adaptive SVQ (ASVQ) adaptively classifies an input vector into one of six types of vectors and applies SVQ encoding.

More particularly, in operation, the output from the spectral masking component 304 is treated as a vector input to the adaptive sparse vector quantization component 306. If desired, input data can be normalized to reduce dynamic range of subsequent vector quantization. This proves to be very useful in audio encoding because of the intrinsic large audio dynamic range. In the preferred embodiment, the ASVQ component 306 classifies each vector into one of six vector types and then SVQ encodes the vector. The output of the ASVQ component 306 are sets of ASVQ indices 318.

The preferred method for quantization of arbitrary input data by adaptive sparse vector quantization comprises the steps of:

(1) grouping consecutive points of the original data into vectors;

(2) adaptively classifying the vectors into one of a plurality of vector types, including at least one sparse vector type;

(3) collapsing each sparse vector into a corresponding compact form;

(4) computing a plurality of vector quantization indices for each compact vector by conventional vector quantization techniques; and (5) formatting the vector quantization indices for each vector type as an output bit-stream.

The method of adaptively classifying vector types is preferably accomplished by categorizing each vector as follows:

(1) vectors with all zero elements (Type 0);

(2) vectors with local clustering (Type I);

(3) vectors with amplitude similarity in non-zero elements (Type II);

(4) dense vectors (Type III);

(5) vectors to which a pre-vector splitting scheme should be applied (Type IV); and (6) vectors to which a post-vector splitting scheme should be applied (Type V).

The method of collapsing sparse vectors is preferably accomplished as follows:

(1) determining locations of non-zero elements for each sparse vector;

(2) computing lengths of regions consisting of consecutive zero elements for each sparse vector;

(3) computing an index representation for each such computed length of region;

(4) deriving a compact vector from the sparse vector by removing all zero elements.

The method of computing the index representation preferably employs recursive enumeration of vectors containing non-negative integer components.

ASVQ is very flexible in the sense that the input vectors can have either low or high dimensionalities. One way to deal with input vectors with high dimensionalities in ASVQ is to pre-split the input down to smaller and more manageable dimensions. This is the classical "divide-and-conquer" approach. However, this fixed mechanism of partitioning may not always make sense in practical situations. ASVQ offers a better alternative in such scenarios. The ASVQ vector-splitting mechanism can internally post-split the input vector, preserving its physical properties. For example, the subband samples for a voiced frame in speech usually consists of several locally clustered spectral components. The exact location for each cluster is data-dependent, which requires an adaptive solution for optimal compression. ASVQ Type V quantization (discussed below) can be employed to achieve this end. ASVQ generally results in variable bit allocations. The variations stem from the adaptive classification of quantization types and potentially from underlying variable vector quantization schemes that support various ASVQ quantization types. ASVQ thus supports differing bit allocations which enable different quality settings for data compression.

Each of the quantization types are described below, followed by an output summary table which identifies preferred output codes; the vector type classification mechanism is then described in greater detail. The preferred output codes are defined as follows:

| Code | Description |
|---|---|
| QTI | Quantization Type Index: 0–5 |
| SDI | Sparse Dimensionality Index: number of non-zero elements in sparse input vector |
| ELI | Element Location Index: index to non-zero element locations |
| SAI | Signal Amplitude Index: index to signal amplitude codebook (Type II only) |
| SBV | Sign Bit Vector: represents sign of non-zero elements (Type II only) |
| VQI | Vector Quantization Indices: indices to the vector quantization codebooks. In a product lattice-pyramid vector quantization implementation, VQI consists of a hyper-pyramid index (HPI) and a lattice-vector index (LVI). In a split-vector full-search VQ approach, VQI consists of a codebook index for each split-vector. |
| VPI | Vector Partition Index: index to partitioning schemes (described below in Type V) |

Type 0 SVQ: This is the trivial case among SVQ types, where the input vector is quantized as a vector of all zero elements. This type uses the least bits for quantization, hence its usefulness.

Type 0 Quantization Output Summary

| Code | Bit Allocation | Name |
|---|---|---|
| QTI | fixed | Quantization Type Index |

Type I SVQ: In a sense, this is the original or generic case of sparse vector quantization. A lossless process is used to determine the location of non-zeros elements in order to generate an Element Location Index (ELI), and a Sparse Dimensionality Index (i.e., the number of non-zero elements in the sparse input vector). The original sparse vector is then collapsed into a vector of all non-zero elements with reduced dimensionality. This reduced vector can then be vector quantized employing any one of conventional vector quantization schemes to produce Vector Quantization Indices (VQI). For example, the product lattice pyramid vector quantization algorithm could be used for this purpose. Type I SVQ does not require a particular range for input vector dimensionality. However, practical implementations may require the input vector to be pre-split down to smaller and more manageable chunks before being sent to the ASVQ quantizer. The technique of using the ELI is perfectly applicable in quantization of binary tree codes and of the best bases in wavelet and cosine packet transforms.

The following describes the lossless process of encoding the Element Location Index. Consider a sparse vector of dimension N with D non-zero elements. The D non-zero elements divide the (N−D) zero elements into D+1 regions. If the number of zero elements in each of the D+1 regions is known, the location of the D non-zero elements can be found by:

$$\begin{aligned}
&\text{location}[0] = n[0]\\
&\text{for} \quad i = 1 \rightarrow D-1\\
&\quad \text{location}[i] = \text{location}[i-1] + 1 + n[i]\\
&\text{end}
\end{aligned}$$

where n[i] is the number of zero-elements in the $i^{th}$ region, and location[i] is the location of $i^{th}$ non-zero element.

Conversely, if the locations of D non-zero elements are known, the number of zero elements in each of the D+1 regions can be found by:

$$\begin{aligned}
&n[0] = \text{location}[0]\\
&\text{for} \quad i = 1 \rightarrow D-1\\
&\quad n[i] = \text{location}[i] - \text{location}[i-1] - 1\\
&\text{end}\\
&n[D] = N - D - \sum_{i=0}^{D-1} n[i]
\end{aligned}$$

Therefore the problem is reduced to encoding n[i],=0–>D. One can see that the n[i] array obeys the following constraints:

$$\begin{aligned}
&n[i] >= 0, \quad i = 0 \rightarrow D\\
&\sum_{i=0}^{D} n[i] = N - D.
\end{aligned}$$

Consequently, the encoding problem becomes the indexing problem for a D+1-dimensional vector with non-negative integer components and L1-norm of N−D, where L1-norm is the sum of the absolute values of vector components. This indexing problem can be solved as follows:

$$\begin{aligned}
&index = 0\\
&i = 0\\
&k = N - D\\
&l = D + 1\\
&while \;\; k \neq 0\\
&\quad if \;\; n[i] > 0\\
&\qquad index = index + \sum_{j=0}^{n[i]-1} N(l-1, k-j)\\
&\qquad k = k - n[i]\\
&\quad end\\
&\quad l = l - 1\\
&\quad i = i + 1\\
&end
\end{aligned}$$

where N(l,k) is given by the following recursive relationships:

$$\begin{aligned}
&N(0,0)=1\\
&N(0,k)=0, \; k>0\\
&N(1,k)=1, \; k>0\\
&N(d,0)=1, \; d>0\\
&N(d,1)=d, \; d>0\\
&N(d,k)=N(d,k-1)+N(d-1,k), \; d,k>1
\end{aligned}$$

Type I Quantization Output Summary

| Code | Bit Allocation | Name |
|---|---|---|
| QTI | fixed | Quantization Type Index |
| SDI | fixed | Sparse Dimensionality Index |
| ELI | variable | Element Location Index |
| VQIs | variable | Vector Quantization Indices |

Type II SVQ: This can be considered a very special case of Type I SVQ. In Type II SVQ, all non-zero elements have, based on some thresholding or selection criteria, close or similar magnitudes. In such a scenario, only the element location index, magnitude, and sign bits of non-zero elements need to be encoded. This type of SVQ achieves significant reduction in required bits when compared to the Type I SVQ.

Type II Quantization Output Summary

| Code | Bit Allocation | Name |
|---|---|---|
| QTI | fixed | Quantization Type Index |
| SDI | fixed | Sparse Dimensionality Index |
| ELI | variable | Element Location Index |
| SAI | fixed | Signal Amplitude Index |
| SBV | variable | Sign Bit Vector |

Type III SVQ: This is the case of non-sparse or dense vectors. In such cases, it is too expensive in terms of required encode bits to treat the input vectors as Type I SVQ. Thus, a conventional vector quantization technique or split vector quantization scheme may be used. Examples of suitable algorithms may be found in "Vector Quantization and Signal Compression" by A. Gersho and R. Gray (1991), which includes a discussion on various vector quantization techniques including split vector quantization (product coding).

Type III Quantization Output Summary

| Code | Bit Allocation | Name |
|---|---|---|
| QTI | fixed | Quantization Type Index |
| VQIs | variable | Vector Quantization Indices |

Type IV SVQ: This is the case where the input vectors are fairly sparse when considered as a whole (globally sparse), but non-zero elements are concentrated or clustered locally inside the input vector. Such clustered cases result in higher dimensionality in the reduced vector (by collapsing; see Type I SVQ), which requires a subsequent split vector quantization technique. Notice that the dimensionality of the reduced vector may not be lowered by simply pre-splitting the input vector before submitting to the ASVQ quantizer, as in the case of Type I SVQ, due to local clustering. However if the definition of Type I SVQ is broadened to allow for subsequent split vector quantization, then Type IV SVQ can be absorbed into Type I SVQ. However, there is good reason to treat Type IV SVQ as a separate type from the Type I SVQ: locally clustered input vectors, time domain or otherwise, usually imply perceptually significant transient signals, like short audio bursts or voiced frames in speech. As such, Type IV SVQ preferably is classified as a separate type that requires more encoding bits.

Type IV Quantization Output Summary

| Code | Bit Allocation | Name |
|---|---|---|
| QTI | fixed | Quantization Type Index |
| SDI | fixed | Sparse Dimensionality Index |
| VQIs | variable | Vector Quantization Indices |

Type V SVQ: This is an extension of Type I SVQ. Type V SVQ deals with input vectors with higher vector dimensionality, in which quantization requires pre-splitting of the input vector for practical reasons. Type I SVQ covers such input vectors if the pre-splitting is performed before quantization. However, in scenarios where pre-splitting is inappropriate, the system has to quantize the input vector as a whole. Such scenarios lead to Type V SVQ. In contrast to Type I SVQ, Type V SVQ performs post-splitting of an input vector, which breaks the input vector into several separate sparse vectors. The number of non-zero elements in each sparse vector is encoded (losslessly) in a so-called vector partition index (VPI). The subsequent quantization of each sparse vector then becomes Type I SVQ without any pre-splitting. The mechanism of encoding VPI is identical to that of ELI.

Type V Quantization Output Summary

| Code | Bit Allocation | Name |
|---|---|---|
| VPI | variable | Vector Partition Index |
| QTI | fixed | Quantization Type Index |
| SDIs | fixed | Sparse Dimensionality Indices |
| ELIs | variable | Element Location Indices |
| VQIs | variable | Vector Quantization Indices |

Figure 5:
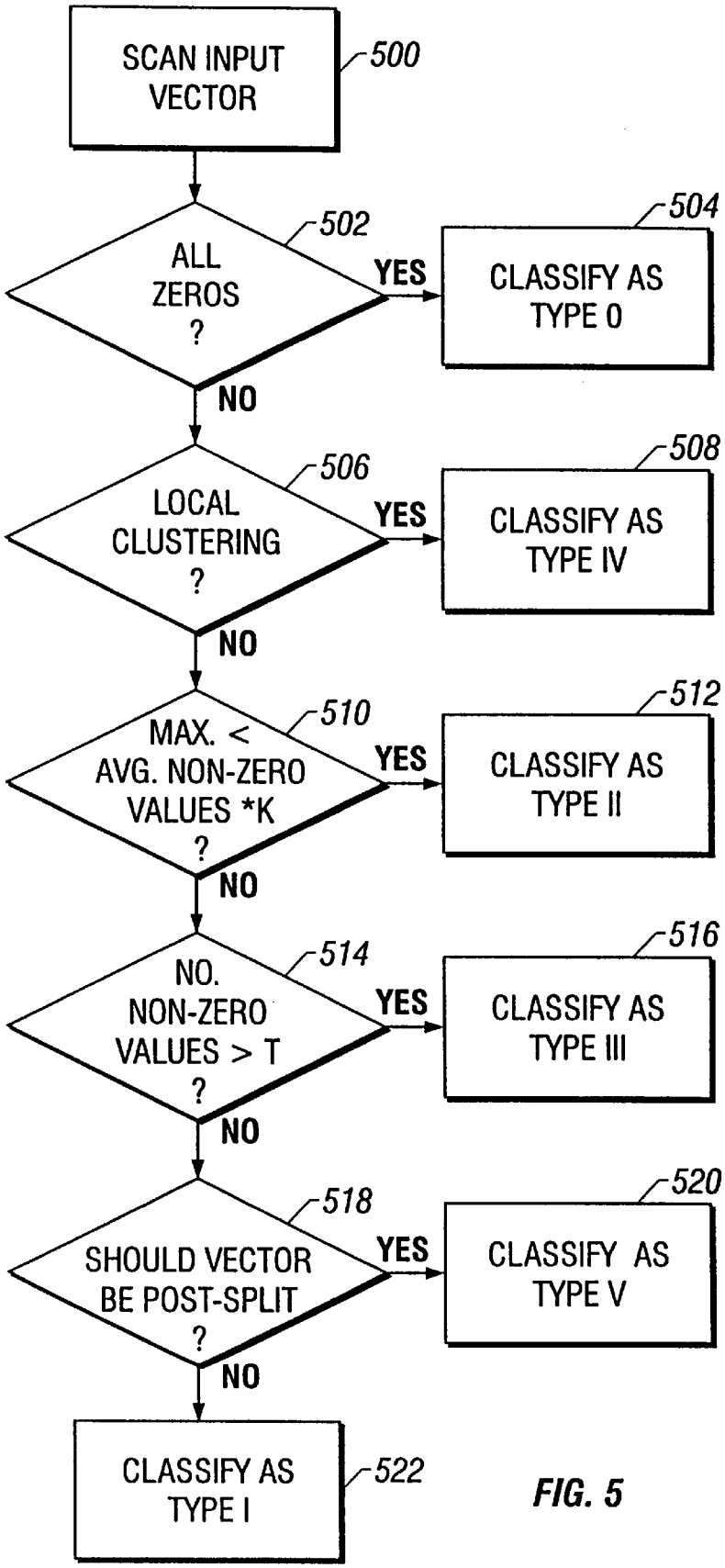
FIG. 5 is a flowchart describing a preferred embodiment of a type classifier in accordance with the invention.

Type Classifier: The type classifier adaptively classifies input vectors into the above mentioned six types of sparse vector quantization. The classification rules are based on sparseness of the input frame, the presence of clusters, and the similarity in amplitudes of non-zero components. There are different approaches to implementing such a type classifier. FIG. 5 is a flowchart describing a preferred embodiment of a type classifier in accordance with the invention. The process includes the following steps, which need not necessarily be performed in the stated order:

Scan the input vector (STEP 500).

If the input vector consists of all zero elements (STEP 502), classify the input vector as Type 0 (STEP 504).

Otherwise, test for local clustering in the input vector based on three criteria:

(1) the maximum amplitude of the unnormalized input vector should be greater than a threshold value, which ensures that the input vector contains strong signal components;

(2) the number of strong normalized non-zero elements, determined by thresholding, should exceed a threshold value, which ensures a high number of strong non-zero elements; and (3) the weighted and normalized standard deviation of non-zero element positions should be smaller than a threshold value, which ensures local clustering.

If all three criteria are met (STEP 506), the input vector is classified as Type IV (STEP 508).

Otherwise, test whether the maximum magnitude of the input vector is less than the mean of non-zero amplitudes of the input vector times a factor K (e.g., 2.0) (STEP 510). If so, then the input vector is classified as Type II (STEP 512).

Otherwise, if the number of non-zero elements in the input vector is greater than a threshold value T (STEP 514), the input vector is classified as Type III (STEP 516).

Otherwise, based on whether pre-splitting or post-splitting makes more sense for a particular application (the criteria are dependent on the physical properties of the input) (STEP 518), determine whether to use Type V (STEP 520) or Type I (STEP 522).

Bit-stream Formatting

The ASVQ indices 318 output by the ASVQ component 306 are then formatted into a suitable bit-stream form 320 by the bit-stream formatting component 308. In the preferred embodiment, the format is the "ART" multimedia format used by America Online and further described in U.S. patent application Ser. No. 08/866,857, filed May 30, 1997, entitled "Encapsulated Document and Format System", assigned to the assignee of the present invention and hereby incorporated by reference. However, other formats may be used, in known fashion. Formatting may include such information as identification fields, field definitions, error detection and correction data, version information, etc.

The formatted bit stream represents a compressed audio file that may then be transmitted over a channel, such as the Internet, or stored on a medium, such as a magnetic or optical data storage disk.

Rate Control

The optional rate control component 310 serves as a feed back loop to the spectral masking component 304 to control the allocation of bits. Rate control is a known technique for keeping the bit-rate within a user-specified range. This is accomplished by adapting spectral-masking threshold parameters and/or bit-allocations in the quantizer. In the preferred embodiment, rate control affects two components in the encoder 300. In the spectral masking component 304, varying spectral masking thresholds determines the sparsity of the spectrum to be encoded downstream by the ASVQ component 306. Higher spectral masking thresholds yield a sparser spectrum which requires fewer bits to encode. In the ASVQ component 306, the bit-rate can be further controlled via adaptive bit allocation. The rate control process yields higher quality at higher bit rates. Thus, rate control is a natural mechanism to achieve quality variation.

Audio Decoding

Figure 4A:
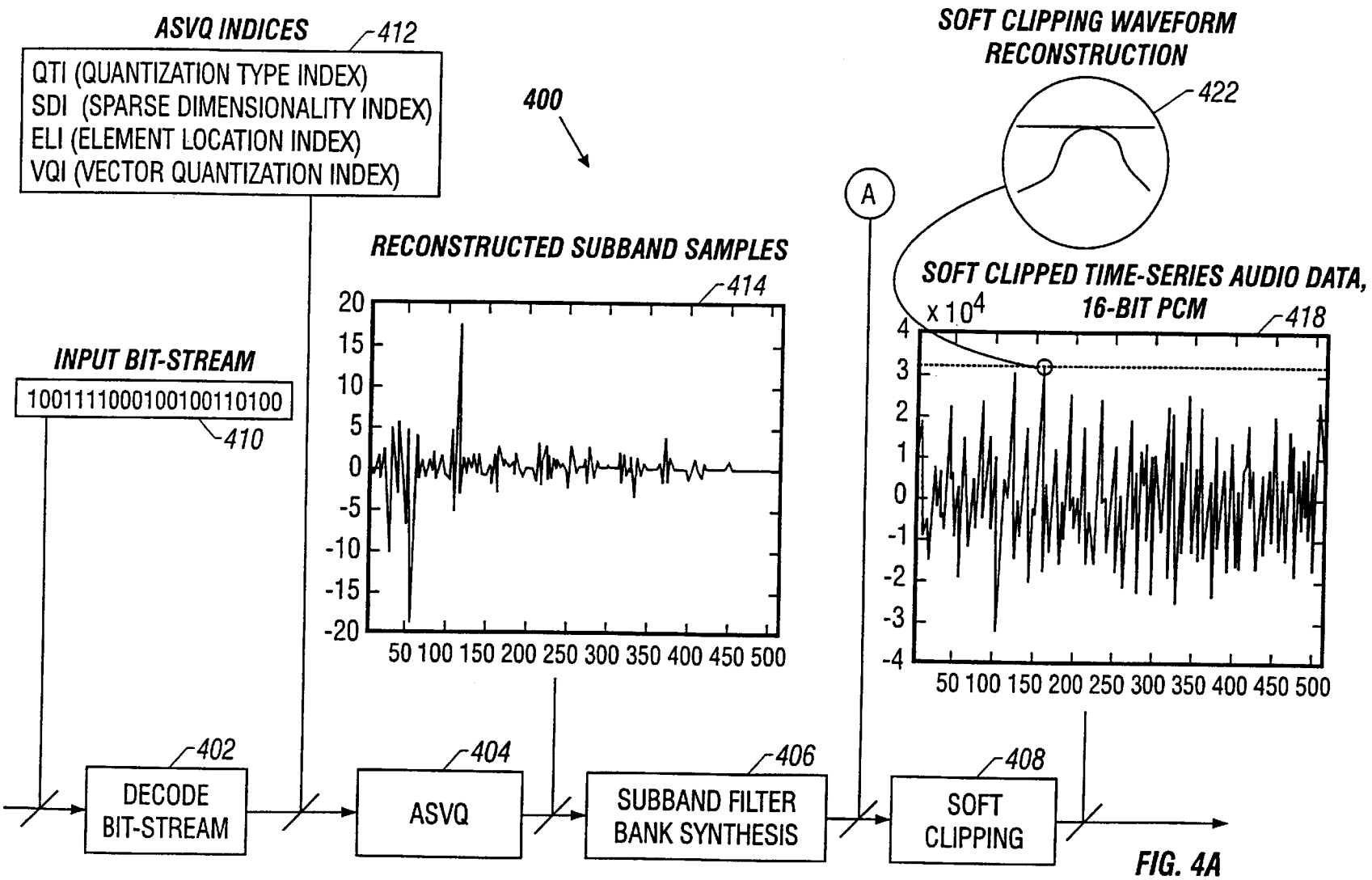
FIG. 4 is a block diagram of a preferred audio decoding system in accordance with the invention.
Figure 4B:
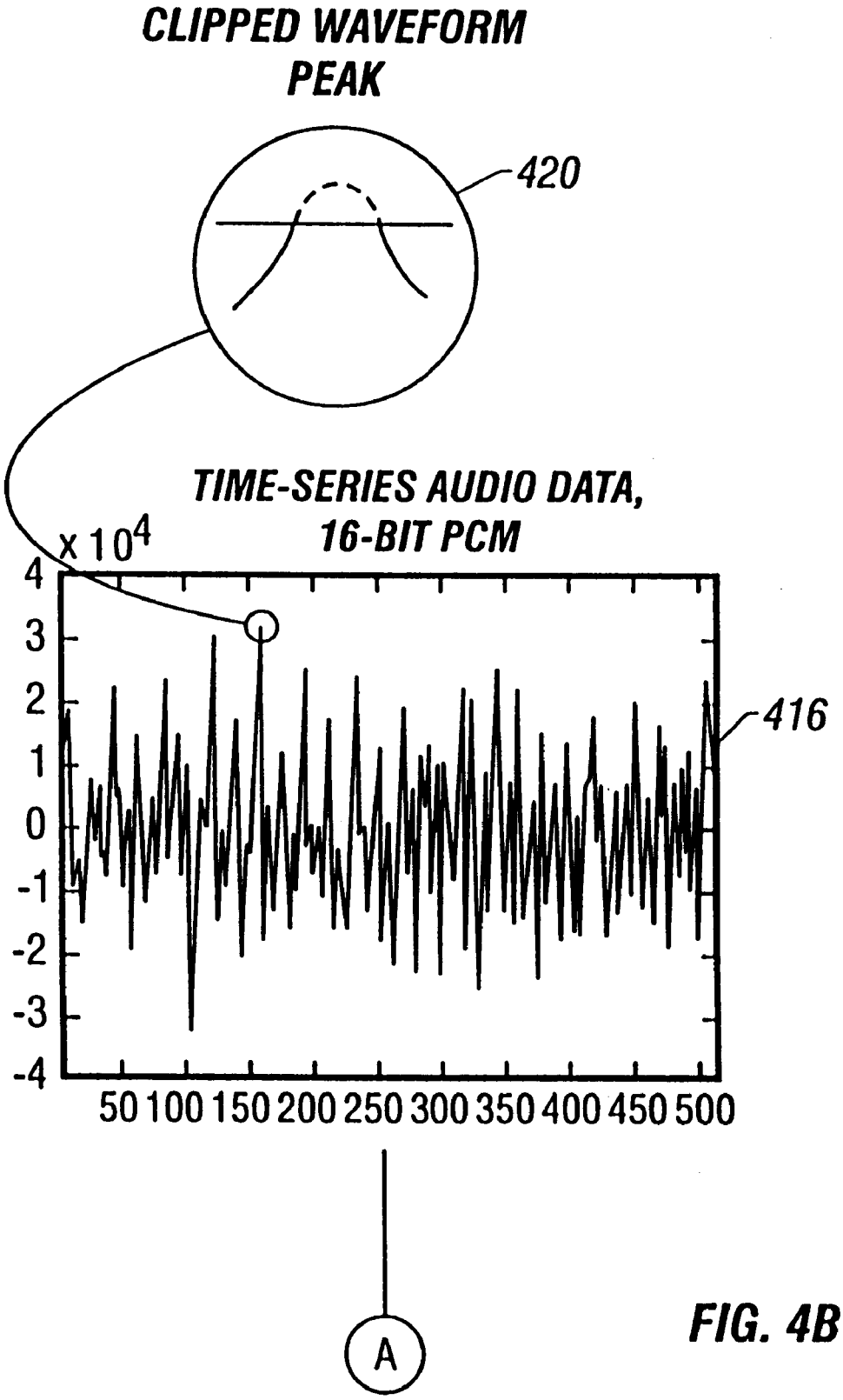

FIG. 4 is a block diagram of a preferred audio decoding system in accordance with the invention. The audio decoder 400 may be implemented in software or hardware, and has four basic components: bit-stream decoding 402; adaptive sparse vector quantization 404; subband filter bank synthesis 406; and soft clipping 408 before outputting the reconstructed waveform.

Bit-stream Decoding

An incoming bit-stream 410 previously generated by an audio encoder 300 in accordance with the invention is coupled to a bit-stream decoding component 402. The decoding component simply disassembles the received binary data into the original audio data, separating out the ASVQ indices 412 in known fashion.

Adaptive Sparse Vector Quantization Decoding

As noted above, "de-quantizing" generally involves performing a table lookup in a codebook to reconstruct the original vector. If the reconstructed vector is in compacted form, then the compacted form is expanded to a sparse vector form. More particularly, the preferred method for de-quantization of compressed bitstream data by adaptive sparse vector de-quantization comprises the steps of:

(1) decoding the input bitstream into a plurality of vector quantization indices;

(2) reconstructing compact vectors from the vector quantization indices by conventional vector de-quantization techniques;

(3) expanding compact vectors into sparse form for each sparse vector type;

(4) assembling sparse vectors into transcoded data.

The method of expanding compact vectors is preferably accomplished by:

(1) computing lengths of regions consisting of consecutive zero elements from the index representation;

(2) determining locations of non-zero elements from the computed lengths of regions;

(3) creating a corresponding sparse vector consisting of all zero elements; and (4) reconstructing each sparse vector by inserting compact vector components in respective determined locations.

The method of computing the lengths of regions preferably employs recursive reconstruction of vectors containing non-negative integer components from the index representation.

As one example, decoding the ASVQ indices 412 involves computing n[i], i=0–>D (where D is as defined above for Type I ASVQ) for an input index value. The preferred algorithm is:

```
n[i] = 0, i = 0 → D
ind = 0
i = 0
k = N − D
l = D + 1
while k > 0
    if index = ind
        n[i] = 0
        break
    end
    j = 0
    forever
        ind = ind + N(l − 1, k − j)
        if index < ind
            n[i] = j
            break
        else
            j++
        end
    end
    k = k − n[i]
    l−−
    i++
```

-continued

```
end
if   k > 0
    n[D] = k − n[i]
end
```

Application of this algorithm to the ASVQ indices 412 will result in generation of reconstructed subband samples 414.

Subband Filter Bank Synthesis

The subband filter bank synthesis component 406 in the decoder 400 performs the inverse operation of subband filter bank analysis component 302 in the encoder 300. The reconstructed subband samples 414 are critically transformed to generate a reconstructed time domain audio sequence 416.

The preferred implementation of the subband filter bank synthesis component 406 is essentially similar to the corresponding filter banks of an MPEG audio decoder, with the following parameter changes:

- The number of subbands should be no less than 64 (versus a typical 32 for MPEG), and preferably 256 or 512 for an 11.025 KHz input signal sample rate. More aggressive windowing is used, as in the encoder (e.g., a Kaiser-Bessel window with beta parameter exceeding 20).
- A shorter history buffer is used to reduce codec latency, typically 12 or 16 times the number of subbands (versus a typical multiplier of 32 for MPEG).
- More aggressive windowing (as in the encoder) is used;
- Each re-constructed audio frame consists of 1 subband sample per subband (versus typically 12 or 36 for MPEG, layer dependent).
- The well-known Fast Discrete Cosine Transform (Fast DCT) is used in performing the Inverse Modified DCT algorithm of the MPEG Audio standard.

Soft Clipping

Signal saturation occurs when a signal exceeds the dynamic range of the sound generation system, and is a frequent by-product of low bit-rate audio compression due to lossy algorithms. An example of such a signal is shown in enlargement 420 in FIG. 4. If a simple and naive "hard clipping" mechanism is used to cut off the excess signal, as shown by the solid horizontal line in enlargement 420, audible distortion will occur. In the preferred embodiment, an optional soft clipping component 408 is used to reduce such spectral distortion.

Soft clipping in accordance with the invention detects the presence of saturation in an input frame or block. If no saturation is found in the input frame or block, the signal is passed through without any modifications. If saturation is detected, the signal is divided into regions of saturation. Each region is considered to be a single saturation even though the region may consist of multiple or disconnected saturated samples. Each region is then processed to remove saturation while preserving waveform shapes or characteristics. The algorithm also takes care of continuity constraints at frame or block boundaries in a stateless manner, so no history buffers or states are needed. The results are more natural "looking" and sounding reproduced audio, even at lower quality settings with higher compression ratios. Further, for over-modulated original material, the inventive algorithm reduces associated distortion. The preferred implementation is described as follows:

(1) Saturation detection: Perform frame-oriented or block-oriented saturation detection as follows:

```
i = 0,
while    i < N − 1,
    if   S(i) < MIN_VALUE || S(i) > MAX_VALUE
         j = i
         while    j < 0 & abs(S(j)) > min_amp
              j−−
         end
         ilo = j
         j = o
         while    j < N − 1 & abs(S(j)) > min_amp
              j++
         end
         ihi = j
         saturationFound
         leftEdge = ilo
         rightEdge = ihi
         i = ihi
    end
    i++
end
```

where N is the number of samples in a signal frame or block, MIN_VALUE and MAX_VALUE are minimum and maximum signal values for a given signal dynamic range, respectively, and min_amp is the amplitude threshold.

(2) Scaling saturated regions: Soft clipping for each saturation region is achieved through point-wise multiplication of the signal sequence by a set of scaling factors. All of the individual multiplication factors constitute an attenuation curve for the saturated region. A requirement for the attenuation curve is that it should yield identity at each end. Each saturation region can be divided into contiguous left, center, and right sub-regions. The center region contains all the saturated samples. The required loss factors for the center region can be simply determined by a factor that is just sufficient to bring all saturated samples within the signal dynamic range. The attenuation factors for the remaining two sub-regions can be determined through the constraint that the resulting attenuation curve should be continuous and, ideally, smooth. Further, it is preferable to maintain the relative order of the absolute sample values, i.e., a larger absolute sample value in the original signal should yield a larger clipped absolute sample value.

The final output results in an uncompressed, soft-clipped signal 418 that is a version of the reconstructed time domain audio sequence 416. The peak amplitude characteristics of the soft-clipped signal 418 are similar to that shown in enlargement 422, where the approximate shape—and thus spectral characteristics—of the saturated input signal are preserved while reducing the amplitude of the signal below the saturation threshold; compare enlargement 420 with enlargement 422.

Computer Implementation

The invention may be implemented in hardware or software, or a combination of both. However, preferably, the invention is implemented in computer programs executing on programmable computers each including at least one processor, at least one data storage system (including volatile and non-volatile memory and/or storage elements), at least one input device, and at least one output device. Program code is applied to input data to perform the functions described herein and generate output information. The output information is applied to one or more output devices, in known fashion.

Figure 6:
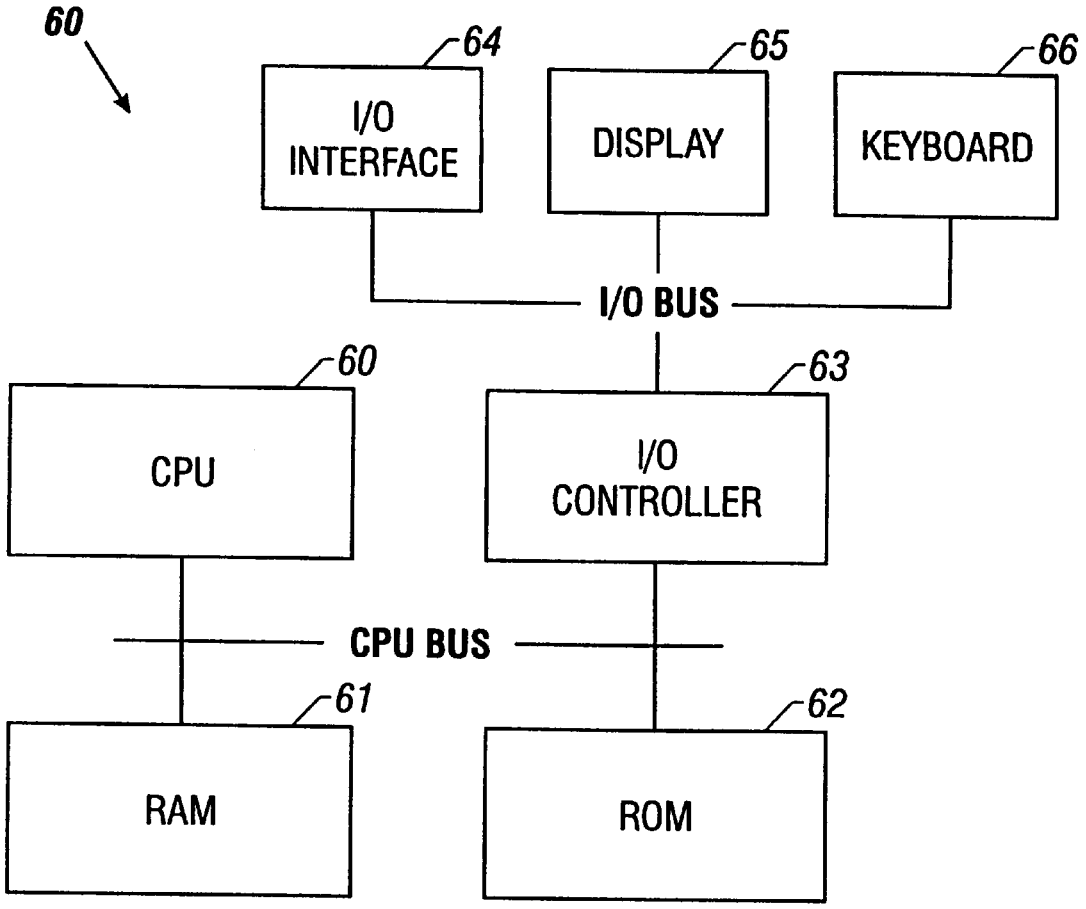
FIG. 6 shows a block diagram of a programmable processing system that may be used in conjunction with the invention.

By way of example only, FIG. 6 shows a block diagram of a programmable processing system 60 that may be used in conjunction with the invention. The processing system 60 preferably includes a CPU 60, a RAM 61, a ROM 62 (preferably writeable, such as a flash ROM) and an I/O controller 63 coupled by a CPU bus. The I/O controller 63 is coupled by means of an I/O bus to an I/O Interface 64. The I/O Interface 64 is for receiving and transmitting data in analog or digital form over a communications link, such as a serial link, local area network, wireless link, parallel link, etc. Also coupled to the I/O bus is a display 65 and a keyboard 66. Other connections may be used, such as separate busses, for the I/O Interface 64, display 65, and keyboard 66. The programmable processing system 60 may be pre-programmed, or may be programmed (and reprogrammed) by downloading a program from another source (e.g., another computer).

Each program is preferably implemented in a high level procedural or object oriented programming language to communicate with a computer system. However, the programs can be implemented in assembly or machine language, if desired. In any case, the language may be a compiled or interpreted language.

Each such computer program is preferably stored on a storage media or device (e.g., CDROM or magnetic diskette) readable by a general or special purpose programmable computer, for configuring and operating the computer when the storage media or device is read by the computer to perform the procedures described herein. The inventive system may also be considered to be implemented as a computer-readable storage medium, configured with a computer program, where the storage medium so configured causes a computer to operate in a specific and predefined manner to perform the functions described herein.

A number of embodiments of the present invention have been described. Nevertheless, it will be understood that various modifications may be made without departing from the spirit and scope of the invention. Accordingly, other embodiments are within the scope of the following claims.

What is claimed is:

1. A method for removing saturation in a reproduced decoded digital audio signal, formatted in frames, that approximates the original waveform shape, including the steps of:

(a) detecting if any part of the reproduced digital signal within a frame is saturated;

(b) if saturation is detected, then dividing the reproduced digital signal within the frame into regions of saturation;

(c) scaling each region of saturation while maintaining continuity across frame boundaries of the clipped output signal.

2. A computer program, residing on a computer-readable medium, for removing saturation in a reproduced decoded digital audio signal, formatted in frames, that approximates the original waveform shape, including instructions for causing a computer to:

(a) detect if any part of the reproduced digital signal within a frame is saturated;

(b) if saturation is detected, then divide the reproduced digital signal within the frame into regions of saturation;

(c) scale each region of saturation while maintaining continuity across frame boundaries of the clipped output signal.

3. An apparatus for removing saturation in a reproduced decode digital audio signal, formatted in frames, that approximates the original waveform shape, including:

(a) means for detecting if any part of the reproduced digital signal within a frame is saturated;

(b) means for dividing the reproduced digital signal within the frame into regions of saturation if saturation is detected;

(c) means for scaling each region of saturation while maintaining continuity across frame boundaries of the clipped output signal.

* * * * *